United States Patent [19]

Kretchman et al.

[11] Patent Number: 4,947,516

[45] Date of Patent: Aug. 14, 1990

[54] LID RETAINER MECHANISM FOR AUTOMATIC WASHER

[75] Inventors: Gerald L. Kretchman; William H. Gartley, both of St. Joseph Township, Berrien County, Mich.

[73] Assignee: Whirlpool Corporation, Benton Harbor, Mich.

[21] Appl. No.: 253,600

[22] Filed: Oct. 5, 1988

[51] Int. Cl.[5] ..... E05F 1/08

[52] U.S. Cl. ..... 16/289; 16/291

[58] Field of Search ..... 16/289, 290, 291, 293

[56] References Cited

U.S. PATENT DOCUMENTS 2,259,970 10/1941 Benzick ..... 16/291
2,904,853 9/1959 Devery ..... 16/289
3,362,042 1/1968 Salice ..... 16/291
3,545,235 12/1970 Menk .
4,690,468 9/1987 Lau ..... 16/291
4,709,951 12/1987 Stacik et al. .

*Primary Examiner*—Richard K. Seidel
*Assistant Examiner*—Carmine Cuda
*Attorney, Agent, or Firm*—Hill, Van Santen, Steadman & Simpson

[57] ABSTRACT

A lid retainer mechanism is provided for an automatic washer which comprises an over-center spring device connected between the lid and the washer cabinet. As the lid is opened, the mechanism passes through a "centered" position and beyond that point, the mechanism acts to urge the lid into a fully open position. This mechanism is particularly useful in a stacked washer/dryer arrangement where the lid is prevented by the bottom wall of the dryer from opening to a position perpendicular to the top of the washer.

8 Claims, 3 Drawing Sheets

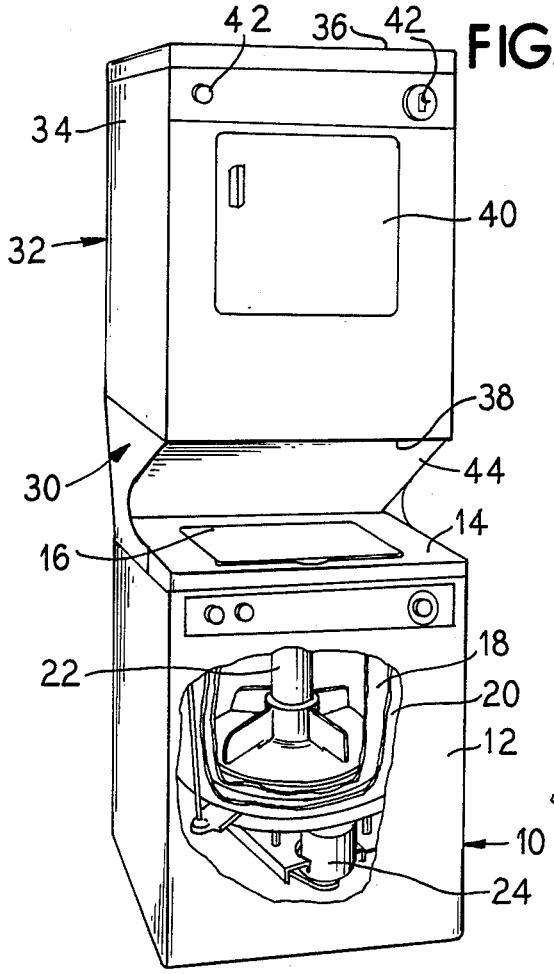
FIG. 1
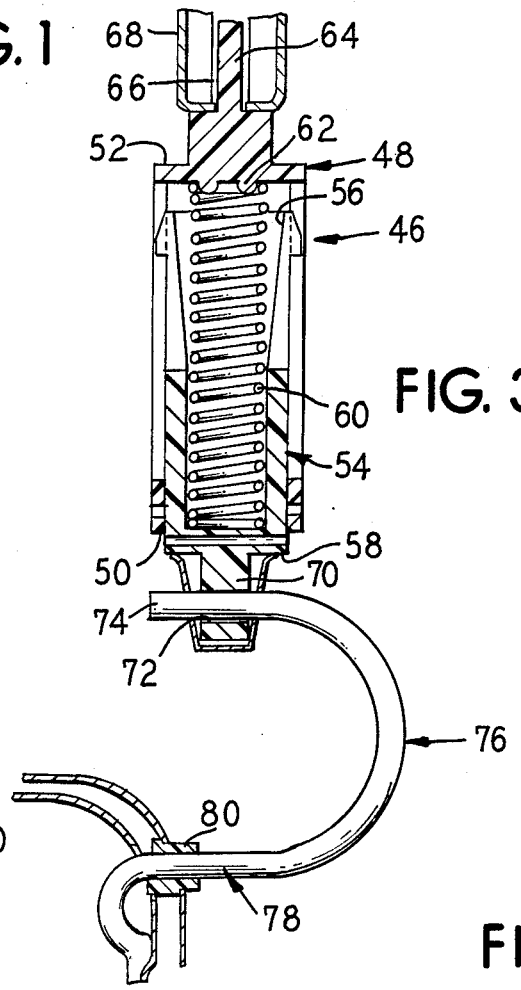
FIG. 3
FIG. 2
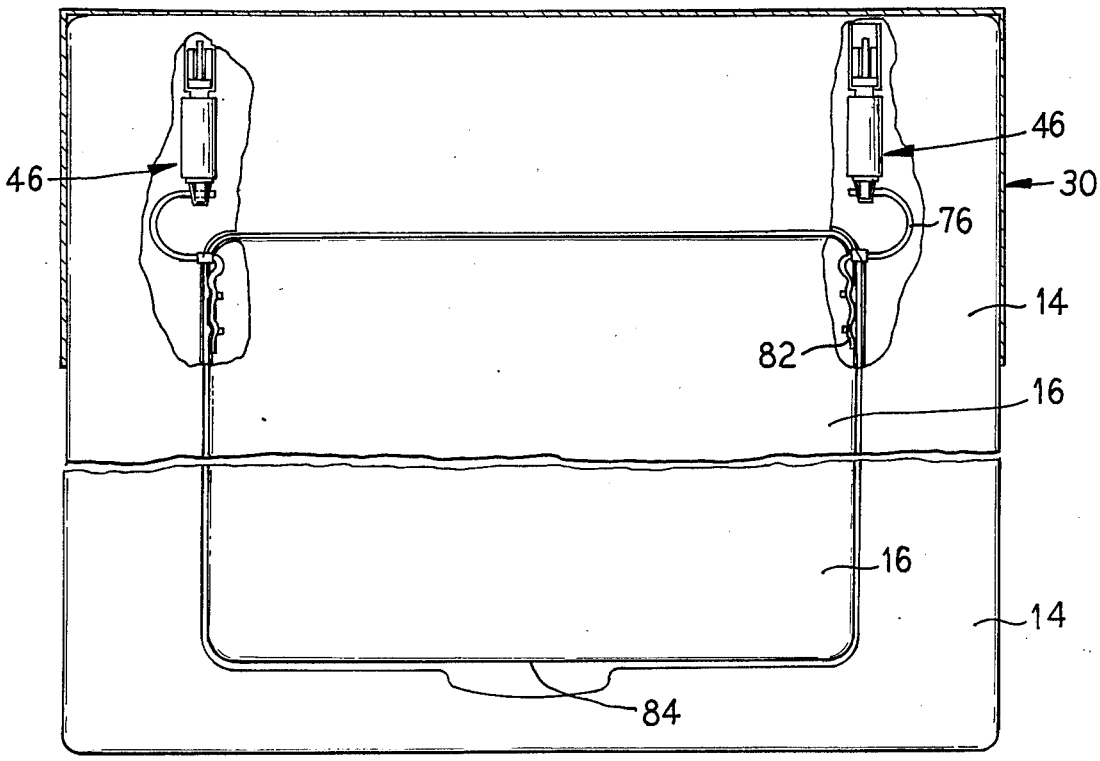

FIG. 4
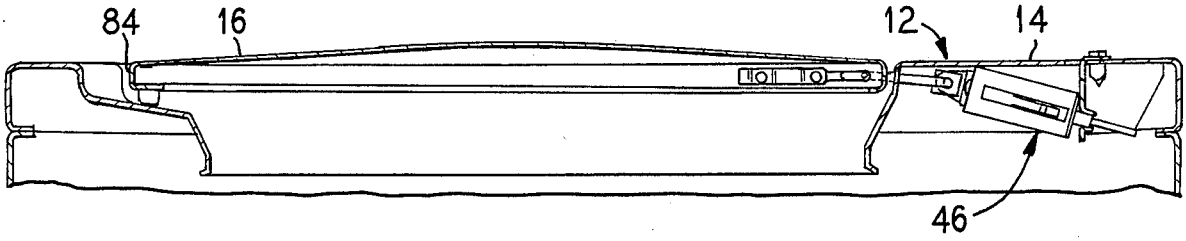
FIG. 5
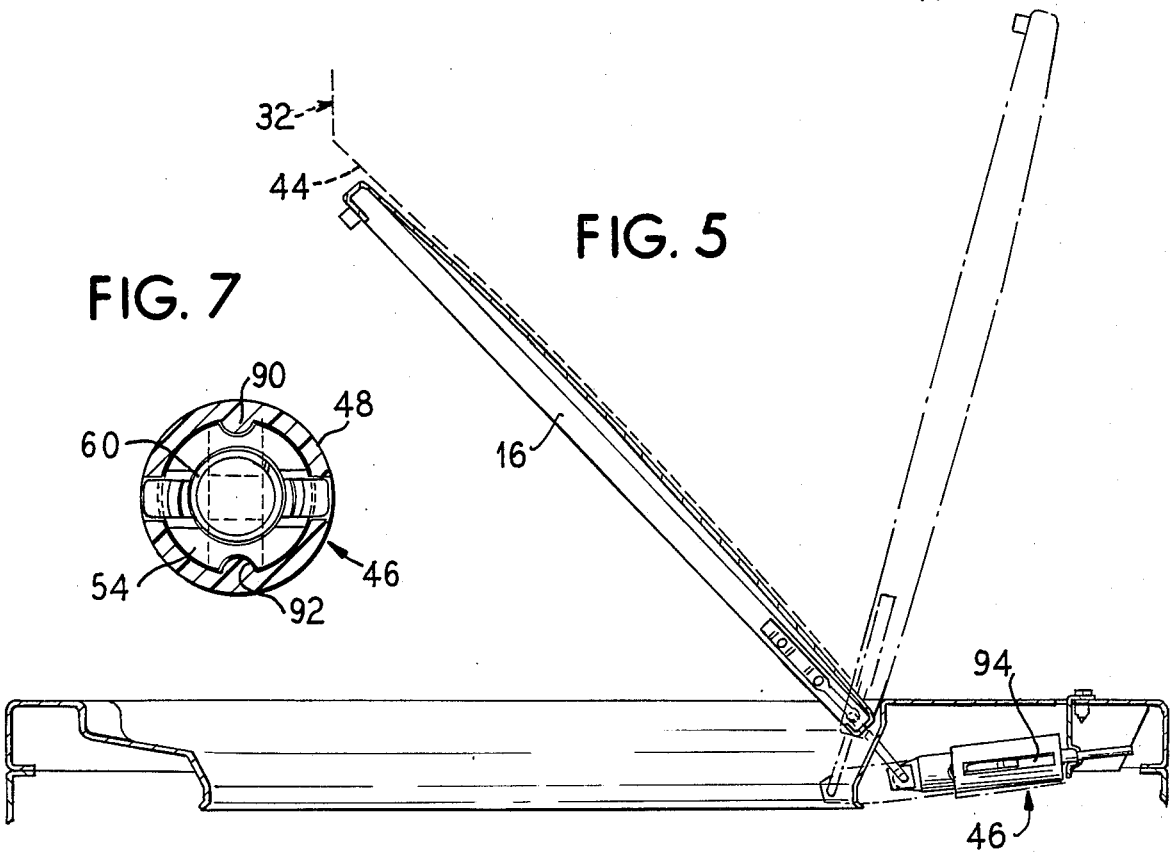
FIG. 7
FIG. 6
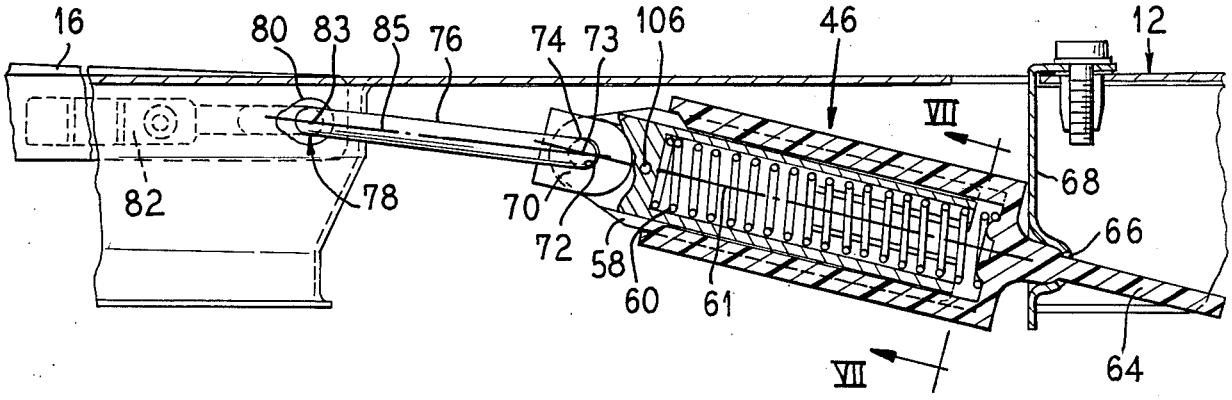

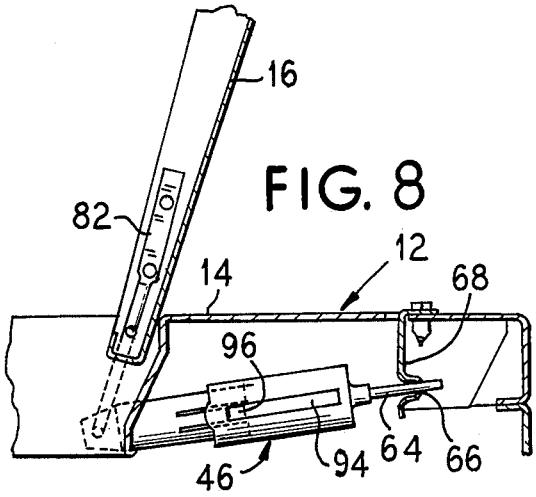
FIG. 8
FIG. 9
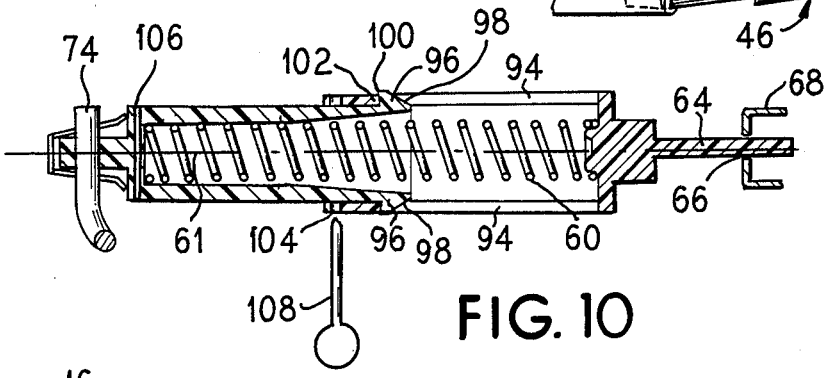
FIG. 10
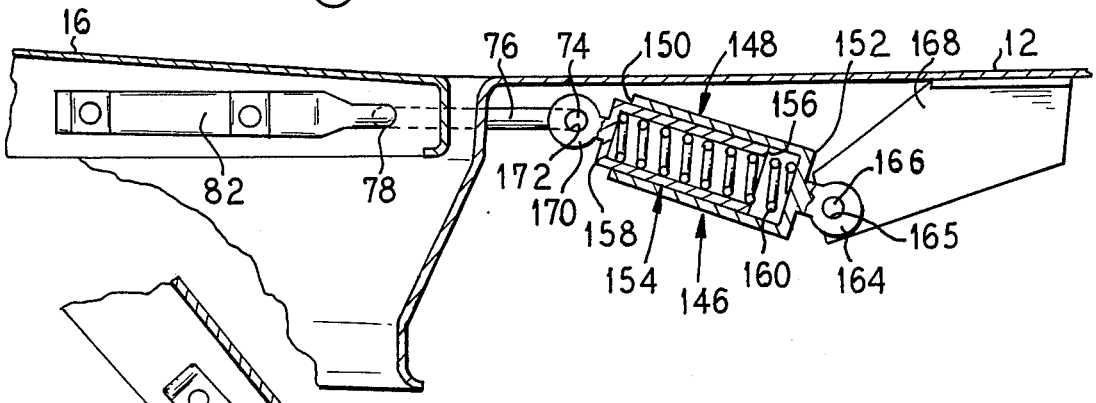
FIG. 11
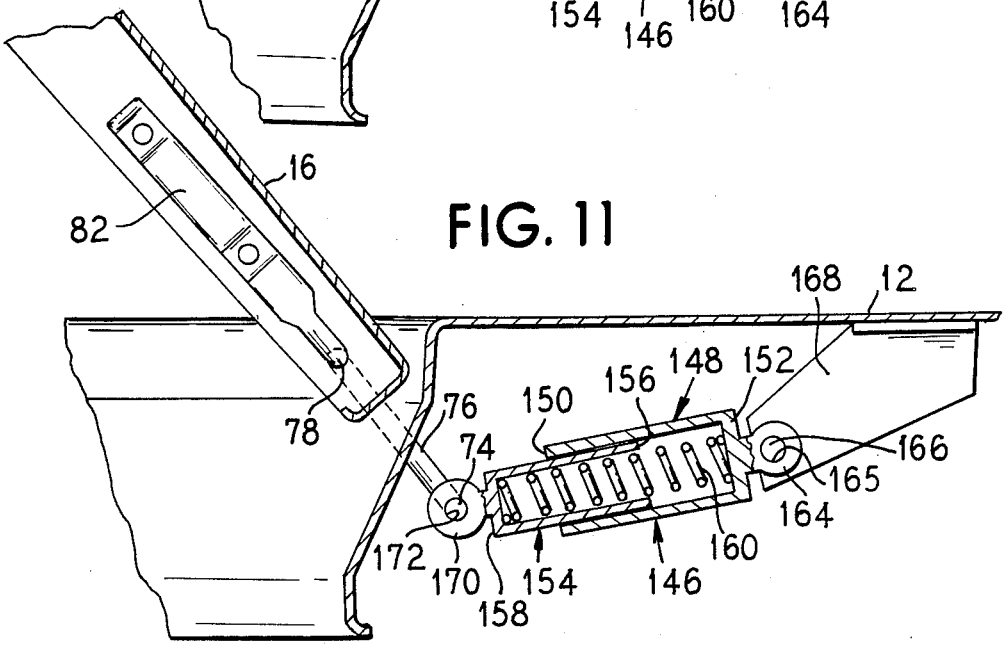

LID RETAINER MECHANISM FOR AUTOMATIC WASHER

BACKGROUND OF THE INVENTION

The present invention relates to automatic washers and more particularly to a mechanism for alternatively holding the lid of an automatic washer in an open or closed position.

Mechanisms to retain washer lids in an open position are well known in the art and, in the arrangements where a dryer is stacked over a washer, such known arrangements include magnetic latching means such as disclosed in U.S. Pat. No. 3,545,235 or gravity operated mechanical latching means such as disclosed in U.S. Pat. No. 4,709,951, assigned to the assignee of the present invention.

Disadvantages associated with these various types of latching arrangements include the fact that some type of unlatching effort is required on the part of the user and, generally, these latching arrangements are visible from the exterior of the cabinet which detract from the aesthetic appearance of the appliance. Therefore, it would be an improvement in the art if a lid retainer mechanism were provided which did not have these drawbacks.

SUMMARY OF THE INVENTION

It is an object of the invention to provide a lid retainer mechanism for an automatic washer which holds the washer lid both in an open position and in a closed position.

It is a further object of the invention to provide a lid retainer mechanism for use with an automatic washer in a stacked washer/dryer combination wherein the mechanism holds the lid up against a stop formed by the dryer cabinet as selected by the user.

It is a still further object of the invention to provide such a lid retainer mechanism wherein the mechanism is concealed from view from the exterior of the cabinet.

It is a still further object of the invention to provide a lid retainer mechanism that operates as an overcenter device which is spring loaded to cause the lid to be held in either an open or closed position.

It is a still further object of the invention to provide a lid retainer mechanism which is easy to assemble together and within the washer during manufacture of the washer.

To achieve these objects, a lid retainer mechanism is provided which is a spring loaded over-center device which includes two plastic cylinders, each with an open end and a closed end, the open ends telescoping together to form a variable length closed cylinder. The spring is carried within the interior of the variable length cylinder. One end of the cylinder is pivotally attached to the washer cabinet while the opposite end of the cylinder is pivotally attached to an extension arm projecting rearwardly beyond the pivot point for the washer lid.

When the lid is in the closed position, flush with the top of the washer cabinet, the spring is held in compression. As the lid is lifted toward the open position, the spring compresses further to a point of maximum compression and then begins to expand as the lid approaches the opened position. The spring is maintained in some compression in the open position such that the spring, acting against the extension arm will hold the lid and continuously bias the lid into the open position. This normally, in the case of a stacked washer/dryer arrangement, occurs while the lid is being pressed against a portion of the dryer cabinet at an angle of less than 90° to the washer cabinet top surface. To return the lid to the closed position, the user merely pulls down on the lid which causes the spring to go into greater compression until it passes the center point at which time the lid will be urged toward the closed position and held there. The cylinder assembly is mounted within the washer cabinet and so the entire mechanism is hidden from view.

In a preferred embodiment, the two cylinder portions are provided with tongue and groove tracks in integral stop members to ensure that the assembly of the two cylinder parts and captured spring do not become disassembled. This assists in the assembly procedure by requiring the handling of only a single part during assembly of the mechanism to the washer cabinet. This also prevents the cylinder assembly from coming apart after assembly.

Also in a preferred embodiment, the one end of the cylinder assembly which attaches to the washer cabinet is both slidingly and pivotally attached so that if the washer lid is opened beyond the normal open position for a stacked washer and dryer combination, the entire cylinder assembly will slide rather than becoming more distended. This reduces the required length for the cylinder assembly. Further holes are provided in the two cylinder parts which can be aligned by compression of the spring and an assembly pin inserted to allow the assembly to be installed into the top assembly of the washer with the lid in the closed position. This further assists in the assembly of the device.

BRIEF DESCRIPTION OF THE DRAWINGS

FIG. 1 illustrates a combination washer and dryer assembly in which the present invention finds particular utility.

FIG. 2 is a plan view of the top panel of the washer, partially cut away to illustrate the lid retainer mechanism incorporating the principles of the present invention.

FIG. 3 is a sectional view through the lid retainer mechanism shown in FIG. 2.

FIG. 4 is a side sectional view through the washer cabinet top panel and lid showing the lid retainer mechanism in the closed lid position.

FIG. 5 is a side sectional view of the washer cabinet illustrating the lid in two different opened positions.

FIG. 6 is an enlarged sectional view of the lid retainer mechanism shown in the closed position.

FIG. 7 is a sectional view taken generally along the lines VII—VII of FIG. 6.

FIG. 8 is a partial sectional view of the lid retainer mechanism shown in a full opened position.

FIG. 9 is an enlarged sectional view of the lid retainer mechanism shown in a full open position.

FIG. 10 is a side sectional view of an alternative embodiment of the lid retainer mechanism shown in a closed position of the lid.

FIG. 11 is a side sectional view of the alternative embodiment of the lid retainer mechanism shown in the opened position.

DESCRIPTION OF THE PREFERRED EMBODIMENTS

In FIG. 1 there is illustrated a clothes washing machine generally at 10 which has a cabinet formed of side panels 12 and a top panel 14. In the top panel 14 there is a hinged access door 16 which provides access to the interior of the washer wherein a wash basket 18 is concentrically mounted within a wash tub 20. A vertical axis agitator 22 is carried within the wash basket 18 and is selectively driven by an electric motor 24. A plurality of controls are provided near a top front edge of the washer by which a user can select a preprogrammed series of washing, rinsing and drying steps.

A coupling device 30 extends upwardly beyond the top panel 14 of the washer and serves as a mounting arrangement for a dryer 32 which is mounted in a vertical relationship with the washer. The dryer 32 has a cabinet with side panels 34, a top panel 36 as well as a bottom panel 38. A front side panel has a hinged door 40 which provides access to the interior of a rotatable drum in which the clothes are to be placed for drying. Controls 42 are also provided on a front panel of the dryer cabinet through which the user can select a preprogrammed series of drying steps. An angled panel 44 extends from a lower front edge of the dryer cabinet to a rear top edge of the washer cabinet to provide a finished appearance of the cabinet between the washer and dryer and to shield the bottom side of the dryer from view.

As seen in FIG. 2, below the top panel 14 of the washer is located a pair of lid retainer mechanisms 46, one at either lateral side rearward of the washer lid 16.

As best seen in FIG. 3, the lid retainer mechanism 46 comprises a first cylindrical part or member 48 having an open forward end 50 and a closed rear end 52. A second cylindrical part or member 54 has an open rear end 56 and a closed forward end 58. An external diameter of the second cylindrical part 54 is just slightly less than an internal diameter of the first cylindrical part 48 such that the two cylindrical parts may nest together at their open ends that the lid retainer mechanism 46 comprises a variable length closed cylinder.

A biasing means such as a coil spring 60 having a central axis 61 and an external diameter slightly less than an internal diameter of the second cylindrical part 54 is carried within the interior of the variable length cylinder. An annular boss 62 is formed within the first cylindrical part 48 at the closed rear end 52 to provide a seat for the spring to prevent the spring from dislodging within the closed cylinder.

The first cylindrical part 48 has a tail 64 projecting outwardly from the closed rear end 52. This tail 64 slidingly fits within an aperture 66 in a bracket 68 secured to the washer cabinet 12 (see FIG. 6) to permit a pivoting movement of the first cylindrical part 48 relative to the washer cabinet.

The closed forward end 58 of the second cylindrical part 54 has a projecting portion 70 formed thereon with an aperture 72 formed therethrough. Received in the aperture 72 to pivot about an axis 73 is a first end 74 of an extension arm 76 of a pivot axle 78 which axle passes through a bearing 80 secured to the washer cabinet and which axle is secured at an opposite end 82 to the washer lid 16. As a front edge 84 of the washer lid is elevated, the lid pivots relative to the top panel 14 of the washer about an axis 83 defined by the axle member 78 where it passes through the bearing 80.

A line 85 defined by the extension arm connecting the lid pivot axis 83 and the second part pivot axis 73 is coplanar with, but angularly displaced from the axis 61 of the spring (FIG. 6). When the lid 16 is in the closed position (FIGS. 4 and 6) the spring 60 is held in compression. As the front edge 84 of the lid is lifted, the spring compresses further as the extension arm line 85 moves into alignment with the axis 61 of the coil spring 60, the extension arm rotating downwardly in a clockwise direction as seen in FIG. 6 and the lid retainer mechanism 46 pivoting downwardly in a counter-clockwise direction as seen in FIG. 6. Once the lid opens sufficiently so that the extension arm moves beyond the point of axial alignment with the coil spring, the spring begins to expand, thus urging the lid upwardly to an open position as seen in FIG. 5. When the dryer 32 is in place, the lid is urged into an open position wherein the lid presses against the angled panel 44. Thus, the lid is held in the open position until the user presses the front edge 84 of the lid downwardly to overcome the bias of the spring and to move the lid back to the closed position.

To prevent rotation of the first part 48 of the lid retention mechanism 46 relative to the second part 54, the interior of the first part includes a pair of opposed inwardly projecting ribs 90 which are received in grooves 92 formed in the outer surface of the second part 54 (FIG. 7).

If the dryer 32 is removed from the top of the washer, or during assembly or certain repairs of the washer or dryer, the lid 16 may be moved to an open position greater than that of the normal open position shown in full lines of FIG. 5 such as to the position shown on FIG. 8. To prevent the lid retainer mechanism 46 from pulling apart in such a situation, a preferred embodiment of the invention provides the first cylindrical part 48 with a pair of opposed, open grooves 94 (FIG. 9) and, provides the second cylindrical part 54 with a pair of opposed resilient tongues 96 which have a bevelled forward edge 98 and a stepped rear edge 100. When the parts are assembled, the spring 60 is inserted into the second part 54 and the assembly of the second part and spring are assembled into the first part 48. The bevelled forward edges 98 of the tongues 96 cause the tongues to flex inwardly as the rearward open end 56 of the second part 54 is inserted into the open forward end of the first part. Once the tongues 96 move into the area of the grooves 94, the tongues spring apart and are captured in the grooves. The stepped rear edge 100 of the tongues 96 abuts against an end wall 102 of the grooves 94 when the closed cylinder is in its fullest extended position. In this manner, the closed cylinder is prevented from inadvertently being disassembled. This also provides an advantage during the manufacturing assembly of the washer in that once the lid retaining mechanism 46 is assembled, only one subassembly needs to be handled rather than the three separate pieces which make up the sub assembly.

When the washer lid 14 is opened beyond the normal open position, the stepped end 100 of the tongue 96 will move toward the end 102 of the groove 94 and, upon abutment therebetween, the entire closed cylinder will slide or move forwardly relative to the washer cabinet. When this occurs, the connection between the lid retaining device 46 and the cabinet is maintained due to the sliding connection of the tail 64 within the bracket 68. Thus, inadvertent disengagement of the lid retaining device from the cabinet is prevented.

An additional feature which provides assistance during assembly of the lid retaining device 46 into the washer 10 is that a pair of aligned apertures 104 are provided in the first part 48 adjacent to the forward open end 50 and a through aperture 106 is provided in the second part 54 adjacent to the closed forward end 58. These holes may be aligned upon compression of the spring 60 and an assembly pin 108 (FIG. 9) can be inserted into the aligned apertures to hold the two cylinder parts in a compressed position which assists in the assembly of the washer lid when the lid is closed relative to the washer cabinet. Once the lid is assembled onto the cabinet, the assembly pins 108 may be removed for reuse, thus placing the lid retaining devices in their operable state.

An alternative embodiment of the invention is illustrated in FIGS. 10 and 11. An alternative configuration of a lid retainer mechanism is shown generally at 146 which comprises a first cylindrical part 148 having an open forward end 150 and a closed rear end 152. A second cylindrical part 154 has an open rear end 156 and a closed forward end 158. An external diameter of the second cylindrical part 154 is just slightly less than an internal diameter of the first cylindrical part 148 such that the two cylindrical parts may nest together at their open ends so that the lid retainer mechanism 146 comprises a variable length closed cylinder.

A coil spring 160 having an external diameter slightly less than an internal diameter of the second cylindrical part 154 is carried within the interior of the variable length cylinder 146.

The first cylindrical part 148 has a projection 164 extending outwardly from the closed rear end 152. The projection 164 has an aperture 165 therethrough to pivotally receive a pivot pin 166 carried by a bracket 168 secured to the washer cabinet 12 to permit a pivoting movement of the first cylindrical part 148 relative to the washer cabinet.

The closed forward end 158 of the second cylindrical part 154 has a projecting portion 170 formed thereon with an aperture 172 formed therethrough. Received in the aperture is the first end 74 of the extension arm 76 of the pivot axle 78 described above.

When the lid 16 is in the closed position (FIG. 10) the spring 160 is held in compression. As the front edge 84 of the lid is lifted, the spring 160 compresses further as the extension arm 76 moves into alignment with the axis of the coil spring 160, the extension arm rotating downwardly in a clockwise direction as seen in FIG. 10 and the lid retainer mechanism 146 pivoting downwardly in a counter-clockwise direction as seen in FIG. 10. Once the lid opens sufficiently so that the extension arm moves beyond a point of axial alignment with the coil spring, the spring begins to expand, thus urging the lid upwardly to an open position as seen in FIG. 11. Thus, this alternative embodiment operates in the same manner to hold the lid in the open position until the user presses the front edge 84 of the lid downwardly to overcome the bias of the spring and to move the lid back to the closed position.

Thus, it is seen that a lid retainer mechanism is provided for an appliance having a cabinet with a top surface and a pivotally openable lid in the top surface which comprises a spring biased means connecting the lid and the cabinet for raising the lid after the lid has been opened beyond a predetermined position. The lid retaining mechanism is a spring biased means which comprises an over-center spring mechanism having a centered position at the predetermined position. Further, the spring biased means is positioned interior of the cabinet so as to be concealed from view from the exterior of the cabinet.

As is apparent from the foregoing specification, the invention is susceptible of being embodied with various alterations and modifications which may differ particularly from those that have been described in the preceeding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A combination washer/dryer wherein a dryer unit is positioned above a washer unit, a pivotal lid, having a free front edge, being attached to the washer unit and pivotable about a first axis toward the dryer unit, a dryer cabinet having an angled panel below said dryer facing said pivotable lid and a lid retainer mechanism, said lid retainer mechanism comprising:

an expandable member comprising two parts nested together, each of said two parts having an open end and a closed end, and being nested together at said open ends to form an expandable closed member, said member being pivotally connected at a first end to said lid to pivot about a second axis, a second end of said member being pivotally and slidably received in an aperture in said cabinet;

a biasing member held in compression along a longitudinal axis within said expandable member continuously urging said two ends of said expandable member apart along said axis of said biasing member;

a line intersecting said first axis and said second axis, such that when said lid is closed, said line is out of alignment with said biasing member axis and as said lid is opened, said line will first move into alignment with said biasing member axis to compress said biasing member and then will move out of alignment with said biasing member axis so that said lid will be urged upwardly by said biasing member into an open position in engagement with said angled panel.

2. A combination washer/dryer wherein a dryer unit is positioned above a washer unit, a pivotal lid, having a free front edge, being attached to the washer unit and pivotable about a first axis toward the dryer unit, a dryer cabinet having an angled panel below said dryer facing said pivotable lid and a lid retainer mechanism, said lid retainer mechanism comprising:

an arm member secured at one end to said lid;

an expandable cylinder comprising two cylindrical parts nested together, each of said two cylindrical parts having an open end and a closed end, and being nested together at said open ends to form an expandable closed cylinder, said cylinder having a projection at a first end wherein it is pivotally connected to another end of said arm to pivot about a second axis, said cylinder having an elongated cylindrical projection at a second end which is pivotally and slidably received in an aperture in a bracket secured to said cabinet;

a coil spring held in compression within said cylinder continuously urging said two ends of said cylinder apart along an axis of said spring;

a line intersecting said first axis and said second axis, such that when said lid is closed, said line is out of alignment with said spring axis and as said lid is opened, said line will first move into alignment with said spring axis to compress said spring and then will move out of alignment with said spring axis so that said lid will be urged upwardly by said spring into an open position.

3. A combination washer/dryer according to claim 2, including means interconnecting said two cylindrical parts to prevent said parts from inadvertently becoming detached from each other.

4. A combination washer/dryer according to claim 3, wherein said means interconnecting said two cylindrical parts comprises at least one channel formed in one of said cylindrical parts parallel to a longitudinal axis of said expandable cylinder and at least one projecting element carried on said other cylindrical part which projects into said channel.

5. A combination washer/dryer according to claim 4, wherein said means interconnecting said two cylindrical parts comprises a pair of opposed channels formed in an outer of said two nested cylindrical parts and a pair of opposed resilient tongues with outwardly projecting ends formed on an inner of said two nested cylindrical parts, said tongues having a bevelled forward end to assist in insertion of said inner part into said outer part, and a stepped rear side to said projecting end which engages with an end of said channel to prevent excessive elongation of said expandable cylinder.

6. A combination washer/dryer according to claim 2, wherein said lid is biased into engagement with angled panel in said open position.

7. A combination washer/dryer according to claim 2, including removable means for securing said two cylindrical parts together in a compressed state of said expandable cylinder to assist in the assembly of said lid retaining mechanism with said combination washer/dryer.

8. A combination washer/dryer according to claim 2, wherein said arm member is journalled in said cabinet to form a pivot for said lid about said first axis.

* * * * *